US010709964B2

(12) United States Patent
Yarro

(10) Patent No.: US 10,709,964 B2
(45) Date of Patent: Jul. 14, 2020

(54) BLOCK BUILDING GAME

(71) Applicant: Tanner James Yarro, Provo, UT (US)

(72) Inventor: Tanner James Yarro, Provo, UT (US)

(73) Assignee: PROTO. TOYS, INC., Provo, UT (US)

( * ) Notice: Subject to any disclaimer, the term of this patent is extended or adjusted under 35 U.S.C. 154(b) by 156 days.

(21) Appl. No.: 15/197,145

(22) Filed: Jun. 29, 2016

(65) Prior Publication Data

US 2018/0001187 A1 Jan. 4, 2018

(51) Int. Cl.

*A63F 9/00* (2006.01)
*A63F 9/26* (2006.01)
*A63H 33/06* (2006.01)

(52) U.S. Cl.

CPC ..... *A63F 9/0079* (2013.01); *A63F 9/0073* (2013.01); *A63F 9/0096* (2013.01); *A63F 9/26* (2013.01); *A63H 33/06* (2013.01); *A63F 2009/009* (2013.01); *A63F 2009/0087* (2013.01)

(58) Field of Classification Search

CPC ..... A63F 9/00; F41B 11/00; A63B 69/40
USPC ..... 273/445, 440; 446/180; 124/16
See application file for complete search history.

(56) References Cited

U.S. PATENT DOCUMENTS 3,080,859 A * 3/1963 Benkoe ..... A63B 69/409 124/64
3,605,328 A * 9/1971 Kilroy ..... A63H 27/14 446/41
3,612,027 A * 10/1971 Makino ..... A63B 69/40 124/16
4,021,036 A * 5/1977 Nelson ..... A63B 47/002 473/459
5,170,522 A * 12/1992 Walker ..... A47C 20/048 5/615
5,261,850 A * 11/1993 Barthold ..... A63H 3/06 446/180
5,294,109 A * 3/1994 Meade ..... A63B 69/40 124/50
5,590,876 A * 1/1997 Sejnowski ..... A63B 69/407 473/417
6,161,497 A * 12/2000 Sallee ..... B60Q 1/48 116/210
6,460,531 B1 * 10/2002 Gourley ..... F41B 11/89 124/64
7,063,325 B1 * 6/2006 Smith ..... A63B 69/0053 273/445
7,458,907 B2 * 12/2008 Wang ..... A63B 69/0002 124/16
9,086,251 B2 * 7/2015 Cummings ..... F41B 11/50
9,220,973 B1 * 12/2015 Stringer ..... A63F 3/00006
2006/0175760 A1 * 8/2006 Holsten ..... A63F 9/00 273/440

(Continued)

*Primary Examiner* — Eugene L Kim
*Assistant Examiner* — Christopher Glenn
(74) *Attorney, Agent, or Firm* — Durham Jones & Pinegar, P.C., Intellectual Property Law Group

(57) ABSTRACT

Apparatus and method of playing a building game against an opponent. The apparatus may include a podium for building a structure with stackable materials such as building blocks. The apparatus may also include an actuator that allows a first player to "blow up" a second players structure if the first player builds his or hers first. The Build or Boom™ game may simply utilize air chambers and a tube but is also capable of utilizing electrical and mechanical means to perform the same functions.

16 Claims, 5 Drawing Sheets

(56) References Cited

U.S. PATENT DOCUMENTS

| | | | | |
|---|---|---|---|---|
| 2009/0045580 | A1* | 2/2009 | Donegan | A63F 9/00 273/447 |
| 2015/0101584 | A1* | 4/2015 | Cummings | F41B 11/89 124/63 |

* cited by examiner

BLOCK BUILDING GAME

TECHNICAL FIELD

This disclosure relates generally to toys and games for play with multiple users and, more specifically, to building games out of blocks or other buildable material on a platform, or podium, capable of being knocked over by an actuator controlled by a separate user. The toys and games can be played with multiple players but may ideally be played between two players.

RELATED ART

For many years now building blocks have been around for children and adults to enjoy building fun new creations. Lincoln Logs® have been a well-known toy for building for nearly 80 years. Other common building blocks toys include standard wooden blocks with multiple shapes and sizes. Many children and adults are familiar with Legos® and other lockable building blocks toys and games.

Additionally games with building blocks have become well known in the art, such as Jenga®. More recently even video games have attempted to recreate the building block style of games in the games Minecraft® and Legos® video games. As is the case with the Jenga® game a single block tower is created and individuals are meant to remove a block and stack it on the top to try and build the tallest tower without it collapsing by removal of the pieces down below.

Even further there are many other building materials and apparatuses for games and toys that are readily available to purchase online or in stores. Each of these games and toys may use different interlocking features, shapes, colors and sizes. Many of these games also just allow a stackable standard wood block allowing a user's imagination to only be limited to the number of blocks he or she uses.

While these toys and games have been utilized for years, there has never been a game or toy that sets two users or racers against one another to build a contraption out of the blocks in a race type setting wherein the first person to build the contraption can "blow up" the other user's or racer's contraption. The idea is to utilize the ingenuity of the builder to build a block design with the excitement of blowing up the competitions design if the racer builds it first or fastest.

SUMMARY

This disclosure, in at least on aspect, relates to the use of a game or toy utilizing building blocks, a platform and a method of "blowing up" a competitors block design. More generally a user attempts to build a design faster than another user and if he or she is successful the first user or builder has the satisfaction of blowing up the second user or builders design.

The game may include at least two platforms that may receive or allow for building blocks to be placed on top of the platforms. In an initial or first position the platform may be stable to allow a user to build a design. Each platform may also include a destabilizing member that causes the platform to move in any of a number of directions to make the platform unstable in a second position. The platform may have a connector, tube or wire or other device that extends from the platform, and more particularly the destabilizing member. The connector, tube or wire leads to an actuator that is in communication with the destabilizing member. The actuator, when actuated, may cause the destabilizing member to move the platform from a first, stable position to a second position which may destabilize the building blocks thus causing whatever blocks that may have been placed on the platform to tumble, knock down, "blow-up" or fall off of one another (i.e. other blocks) or the platform itself.

The game may include block designs with a predesigned configuration of blocks on the front and back of a card. The card is then placed between two competitors or users and the card may be placed in a stand so as to face each competitor with the block design. The game commences as both builders begin building the block design that is shown them on the card. The user to build the design first may then actuate the actuator to knock down the other user's design.

The platform(s) may be simple flat surfaces with a destabilizing member(s) in connection with the platform(s). The destabilizing member may be an air chamber, springs or other methods easily recognized for destabilizing a platform. The actuator may be an accordion like air chamber that when pressed pushes air to a second air chamber, which may be the destabilizing member, which cause the second air chamber to expand, destabilizing the platform. Alternatively the actuator may be a button that sends an electrical signal via a wired or wireless means to a spring. When the spring within the platform receives the electrical signal the spring may extend causing the platform to destabilize.

There is a plurality of means and methods for actuation to destabilize the platform just as there are a plurality of building blocks and materials that may be used for the game itself. Other aspects, as well as features and advantages of various aspects of the disclosed subject matter will become apparent to one of ordinary skill in the art form the ensuing description, the accompanying drawings and the appended claims.

BRIEF DESCRIPTION OF THE DRAWINGS

In the drawings:

FIG. 12 is a cross-sectional side view of an alternate embodiment of the game or system of FIG. 1 in a first position with a building platform and a base plate (or first member and second member) with a bladder positioned in between; and FIG. 13 is a cross-sectional side view of the alternate embodiment of the game or system of FIG. 12 in a second position with a building platform and a base plate (or first member and second member) with a bladder positioned in between.

DETAILED DESCRIPTION

The following description sets forth separate embodiments of a game or toy with a platform and the ability to "blow up" the platform from a distance. A user or builder may build a structure on the platform. The platform member may include an actuated member that may destabilize the platform. An actuator may be used to actuate the actuated member such that when the actuator is activated it causes the actuated member to react causing the platform to destabilize and topple the structure built by a user.

Figure 1:
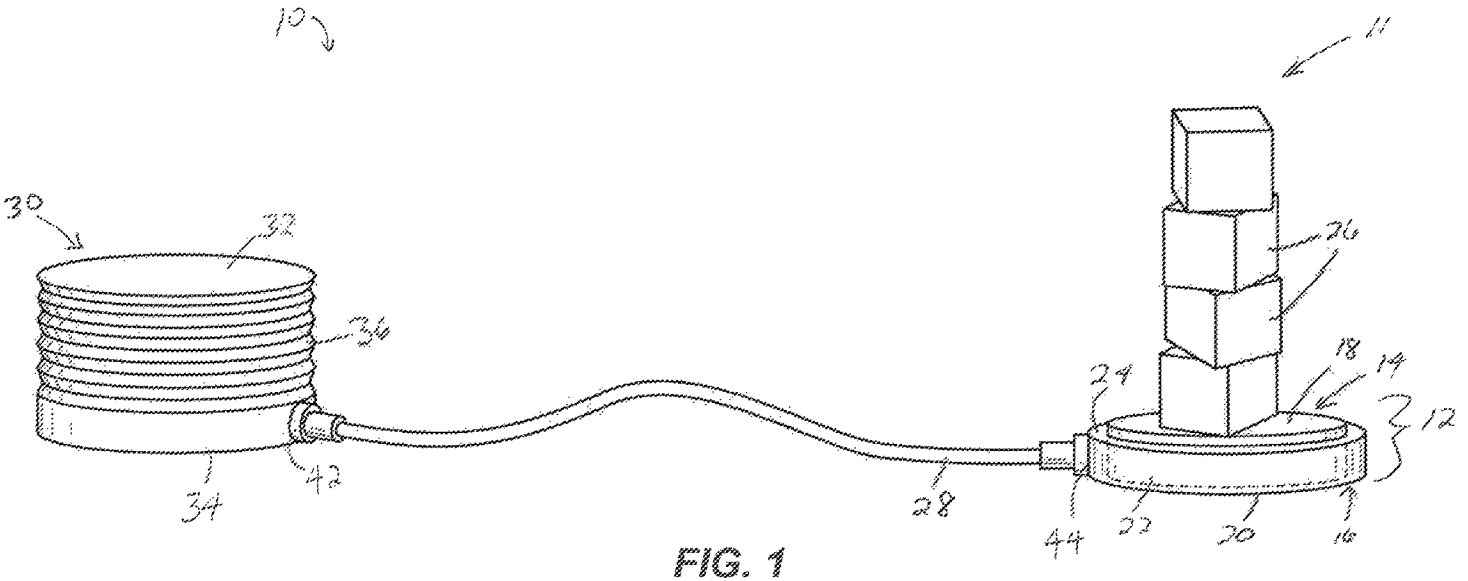
FIG. 1 is perspective view of the game or system with a building plate or platform, a connector and an actuator in a first position.
Figure 2:
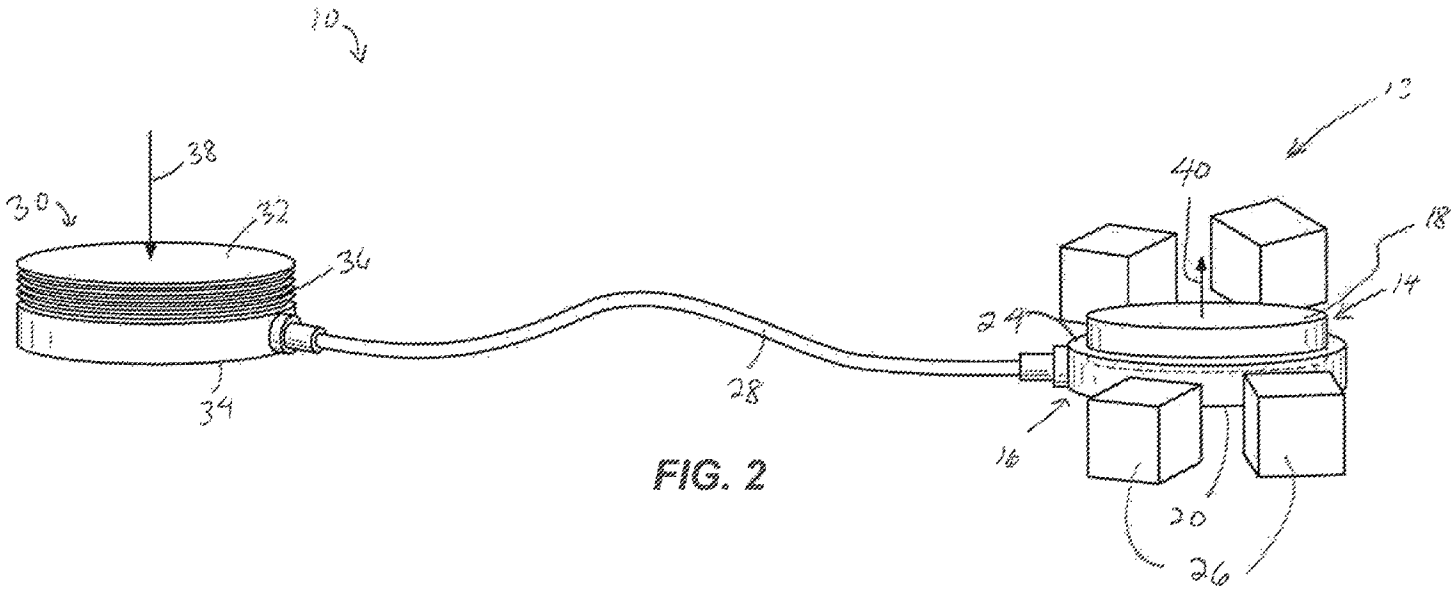
FIG. 2 is perspective view of the game or system of FIG.1 with a building plate or platform, a connector and an actuator in a second position.

FIGS. 1 and 2 illustrate a first embodiment of a game with a system 10 with a platform 12, or podium or building platform, or building plate. The game may be played by using at least two systems 10. Referring to FIG. 1 the first device 10 is in a first position 11. The platform 12 may include a first member 14 and a second member 16. The first member 14 may include a substantially flat top surface 18, or wall wherein the first member 14 may be movable in at least one direction. The second member 16 may include a substantially flat bottom surface 20, or wall, and a void 22 may be positioned within the second member extending from a top of the second member toward the flat bottom wall 20. A second member top surface 24 may circumferentially surround the void 22. The first member 14 may slide within the second member 16 within the void 22 wherein the first member 14 and second member 16 may create an air-tight chamber between the two members. The second member 16 may be configured to sit on a surface such as a table top, or floor or other like surface. The top surface 14 may allow for a structure to be built on top of the top surface 14 out of blocks 26, or other buildable toys, blocks, stackable members or devices.

The platform 12 may be substantially rigid and may be comprised of wood, plastic, rubber or metal. The shape of the platform 12, in a top view perspective, may be any polygonal shape or circular shape.

A channel 28 may extend from the platform 12. The channel 28 may be a conduit, or tube, pipe or wire or other similar device. The channel 28 may extend to and be in connection with an actuator 30. The channel 28 may be an air-tight tube that may allow air to pass from the actuator 30 to the platform 12. The length of the channel 28 may vary. While any length of the channel 28 is contemplated a channel between 10 cm and 100 cm is easily considered. The actuator 30 may include a top actuator surface 32 and a bottom actuator surface 34, wherein both actuator surfaces 32, 34 may be substantially flat. The actuator 30 may be an accordion-like air-chamber 36 within the body of the actuator 30 such that when actuated the air-chamber 36 may collapse pushing air through the channel 28 to the platform 12.

On both the platform 12 and the actuator 30 there may be a first hole 42, or cutout, in a first sidewall of the actuator 30 and a second hole 44, or cutout, in a second sidewall of the platform 12. These holes 42, 44, or cutouts, may allow the channel 28 access to the air-chamber 36 of the actuator 30 and the void 22 of the platform 12 while maintaining the stability of both the actuator 30 and the platform 12.

The actuator 30 may be comprised of pliable material that allows it to be manipulated to push air from the air chamber 36 and thus may be made of any plastic or rubber material that allows for this manipulation. The shape of the actuator 30, likewise, in a top view perspective, may be any polygonal shape or circular shape.

Referring to FIG. 2, the system 10 is shown in a second position 13, when the actuator 30 is actuated by a user in a first direction 38 it may cause the first member 14 to react in a second direction 40. A first direction 38 may be in a down or downward direction and the second direction 40 may be in an up or upward direction. Actuating the actuator 30 may cause the air chamber to push air through the channel 28 to the void 22 of the platform 12. The air entering the void 22 may cause the first member 14 to destabilize or push in the second direction 40 causing the blocks 26 to topple off of the first member 14.

Figure 3:
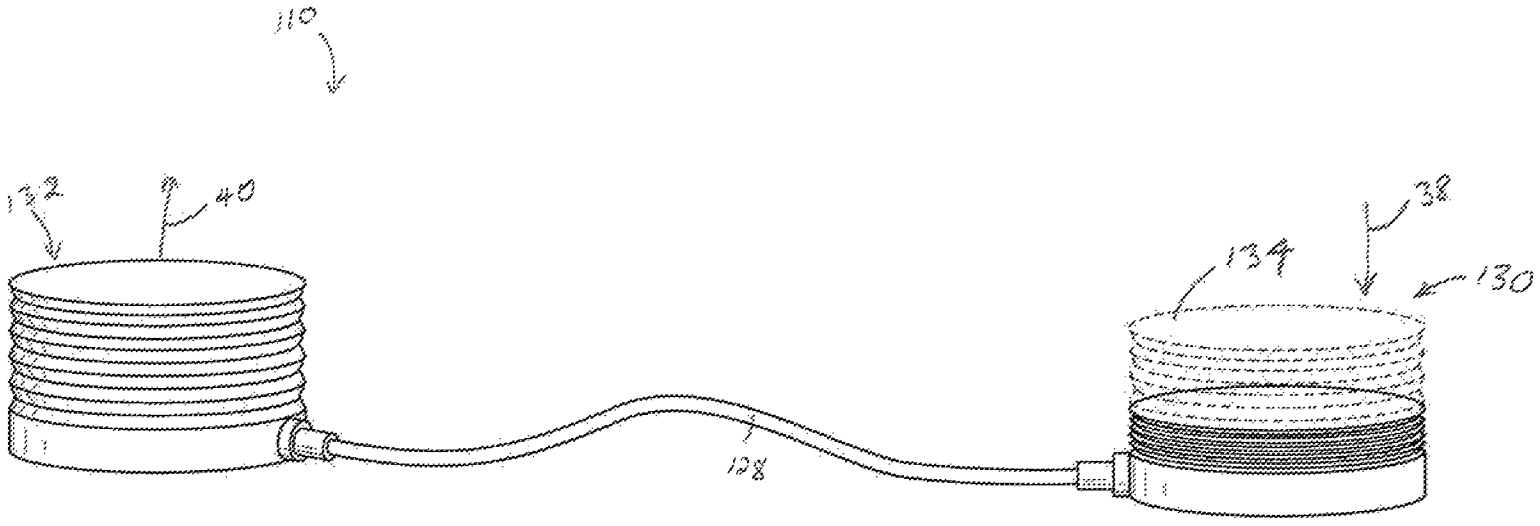
FIG. 3 is a perspective view of an alternate embodiment of the game or system of FIG. 1.

Alternatively, referring to FIG. 3, a system 110 may include a first actuator 130 and a second actuator 132 on each end of a channel 128. Wherein the first actuator 130 may be accordion-like similar to the previous embodiments; however, after the accordion-like first actuator 130 is depressed it may remain depressed to allow for building on top of the first actuator 130 top surface 134. Similar to the previous embodiment, when the second actuator 132 is actuated in a first direction 38 it may cause the first actuator 132 to expand in the second direction 40 causing the blocks 26 to topple off of the first actuator 130. It will be appreciated that this dual actuator system may allow for ease in game play and reset of the system 110. It will also be appreciated that a dual actuator may be done with more than accordion-like actuators that will allow for building on either actuator or either side of the system 110 and that other variations are contemplated herein.

Figure 4:
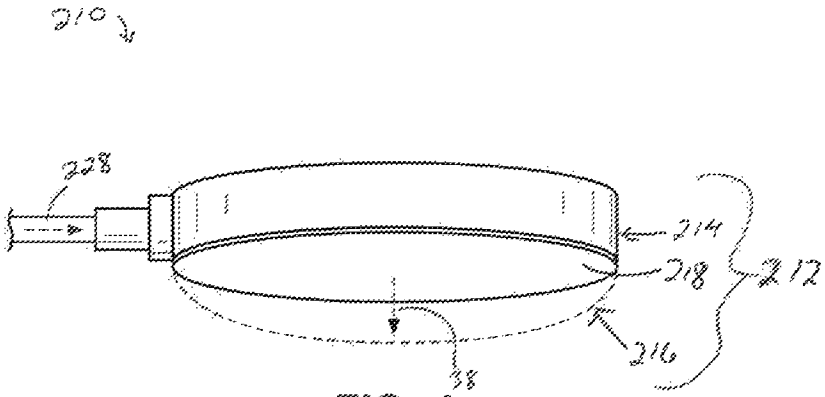
FIG. 4 is one embodiment of a bottom perspective view of platform of FIG. 1.

Referring to FIG. 4, a system 210 may include a platform 212 with a first member 214 and a second member 216. The first member 214 may be substantially rigid and any circular or polygonal shape, from a top view perspective. The second member 216 may extend from a bottom surface 218 of the first member 214. The second member 216 may be a bladder or air chamber or other similar collapsible member that when activated expands in at least one direction (which may be the same direction as the first direction 38) causing the platform 212 to destabilize. The second member 216 may extend the entire length and width (or circumferential length if circular) of the first member 214. The second member 216, when activated, may be bulbous or rounded on the end opposite the first member 214.

Similar to previous embodiments, air may enter the platform 212 and cause the second member 216 to expand. Air may enter the platform 212 in manner as previously disclosed, similar to a void in the platform 212 that allows air to enter and escape through a channel 228.

Figure 5:
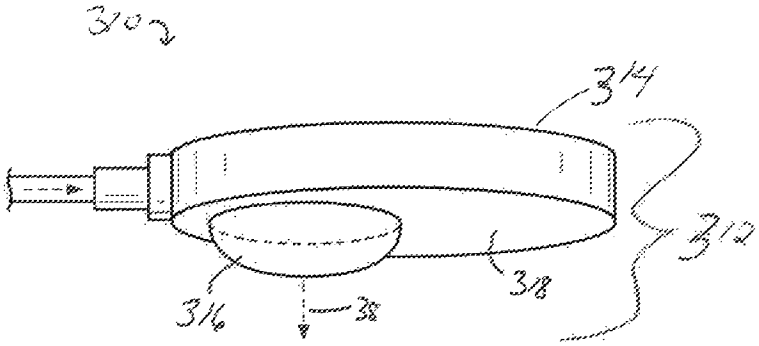
FIG. 5 is an alternate embodiment of a bottom perspective view of platform of FIG. 1.

Referring to FIG. 5, an alternate embodiment platform 312 may be substantially similar as the previous embodiment platform 212, with the exception that a second member 316 extending from a first member 314 may only partially extend along the length of a bottom surface 318 of the first member 314. The second member 316, when activated, may be bulbous or rounded on the end opposite the first member 314.

Figure 6:
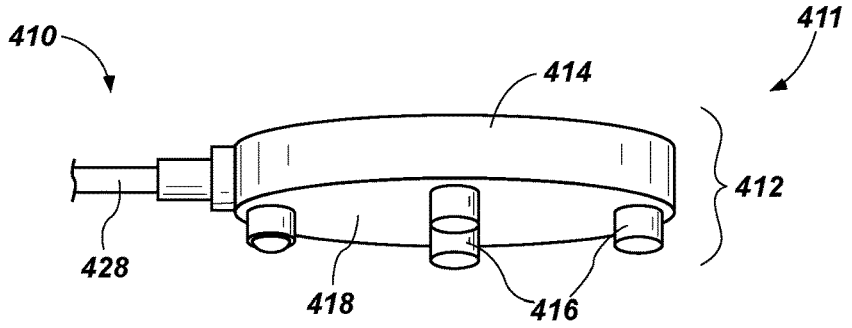
FIG. 6 is an alternate embodiment of a bottom perspective view of platform of FIG. 1 with the platform in a first position.
Figure 7:
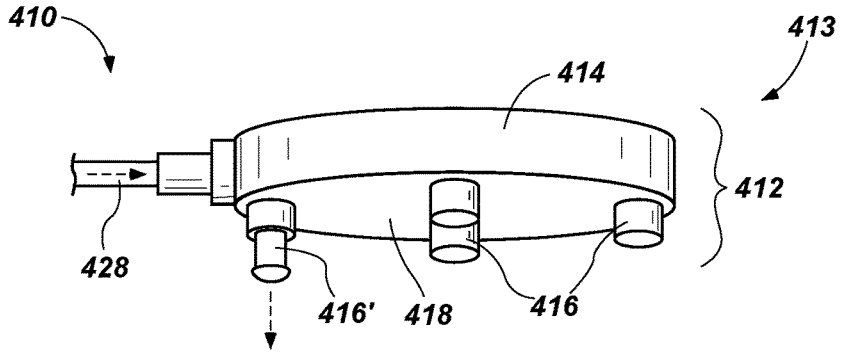
FIG. 7 is an alternate embodiment of a bottom perspective view of platform of FIG. 1 with the platform in a second position.

Referring to FIGS. 6 and 7, an alternate embodiment of a platform 412 is depicted for a system 410. The platform 412 may include a first member 414 with a plurality of posts 416 extending from a bottom surface 418 of the first member 414. While the figures depict 4 posts 416 it will be appreciated that any number of posts is contemplated that may stabilize the platform 412. Referring to FIG. 6 the system 410 is in a first position 411 wherein all the posts 416 are substantially the same length. At least one of the plurality of posts 416' may be extendable when activated. The at least one extendable post 416' may extend in a first direction 38 that may cause the platform 412 to destabilize. The extendable post 416' may actuate when an actuator is activated pushing air through a channel 428 into a void of the platform 412 which then pushes the post to a second position 413 (refer to FIG. 7) which extends the extendable post 416' to be longer in length than the other plurality of posts 416. It will be appreciated that there may be more than one extendable post.

The posts 416, 416' may be cylindrical or other polygonal shape. Actuation of the extendable post 416' may be performed similarly as previously described in this disclosure. Alternatively, the post may be spring actuated that when a user activates the actuator it sends a signal to the spring to extend (greater detail provided herein). The signal to the spring may be mechanical or electrical in nature.

Figure 8:
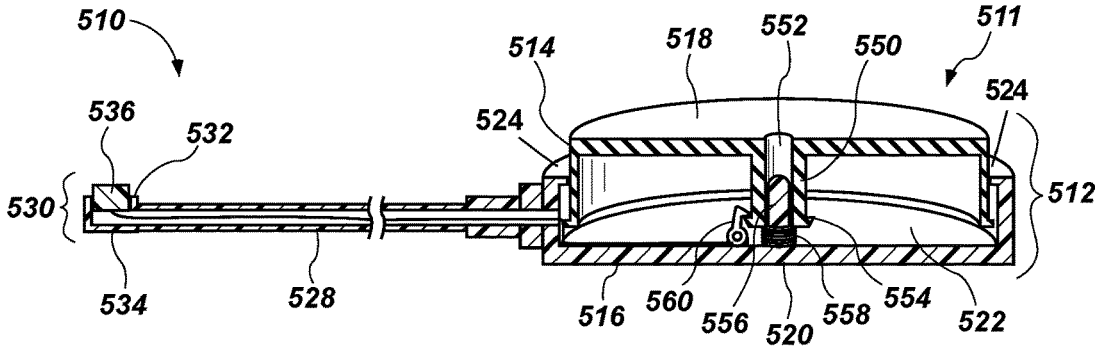
FIG. 8 is a perspective view of an alternate embodiment of the game or system with a building plate or platform, a connector and an actuator in a first position.
Figure 9:
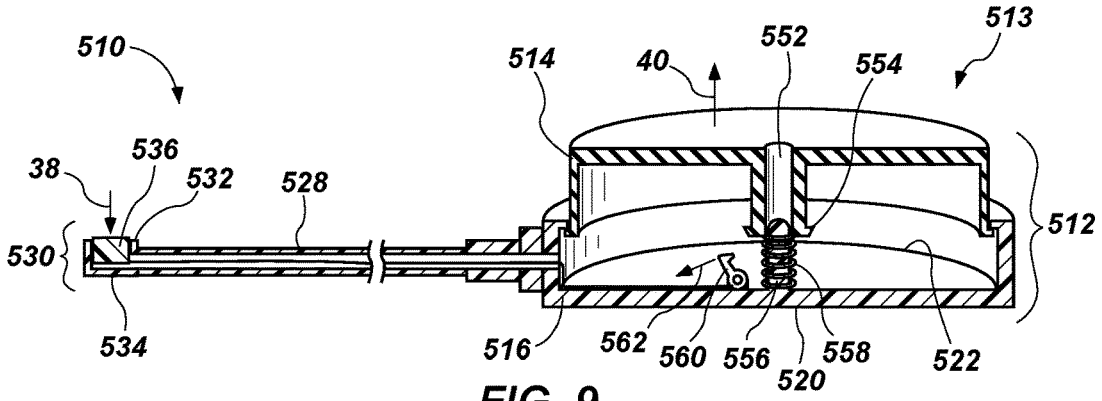
FIG. 9 is perspective view of the game or system of FIG. 8 with a building plate or platform, a connector and an actuator in a second position.

Referring to FIGS. 8 and 9, an alternate embodiment to the system is depicted. While the premise remains the same or similar for game play as the previous embodiments the means to accomplish the goal may be slightly different. Referring to FIG. 8 a system 510 is set in a first position 511. A platform 512 may include a first member 514 and a second member 516. The first member 514 may include a substantially flat top surface 518, or wall wherein the first member 514 may be movable in at least one direction. The second member 516 may include a substantially flat bottom surface 520, or wall, and a void 522 may be positioned within the second member extending from a top of the second member toward the flat bottom wall 520. A second member top surface 524 may circumferentially surround the void 522. The first member 514 may slide within the second member 516 within the void 522. The second member 516 may be configured to sit on a surface such as a table top, or floor or other like surface. The top surface 514 may allow for a structure to be built on top of the top surface 514 out of blocks 26, or other buildable toys, blocks, stackable members or devices.

The first member 514 may further include a first protrusion 550, which may be cylindrical, extending downward from the top surface 518 of the first member 514. The first protrusion 550 may include an aperture 552 which may extend the length of the protrusion 550 from the top surface 518 through the entire first protrusion 550; however, the aperture 552 may also terminate at the top surface 518 and not pass entirely there through. The first protrusion 550 may include a flange 554 toward the distal end of the protrusion and extending laterally from the first protrusion 550.

The second member 516 may include a boss 556 extending from the base of the second member 516. The boss 556 may be positioned to fit within the aperture 552. A spring 558 may be positioned around the boss 556 and may be loose or snug. The spring 558 may be large enough such that it cannot fit within the aperture 552. The spring 558 may be compressed when the first member 514 slides within the second member 516 of the platform 512. The first protrusion 550 may receive the boss 556 and compress the spring 558.

The second member 516 may further include a clip 560, or actuation member, which is capable of engaging the flange 556 on the first protrusion 550. The clip 560 may be spring loaded and when the first member 514 is pushed into, or onto, the second member 516 the flange 556 catches the clip 560. The clip may include a tapered barb or ridge that allows the first member 514 with the first protrusion 550 to advance in only one direction toward the second member 516. It will be appreciated that the clip 560 may include multiple barbs or ridges so the more the first member 514 is advanced toward the second member 516 the more compressed the spring 558 becomes and the more violent the "explosion" when actuated.

The clip 560 may be electrically, or mechanically, connected to an actuator 530. A channel 528 may extend from the platform 512 to the actuator 530 which may be a button of some form. The channel 528 may be a conduit, or tube, pipe or wire or other similar device. The actuator 530 may include a top actuator surface 532 and a bottom actuator surface 534, wherein both actuator surfaces 532, 534 may be substantially flat. Referring to FIG. 9, the actuator 530 may be an electronic button 536 that sends an electronic signal to the clip 560 causing the clip to release the flange 556 in a third direction 562 thus decompressing the spring 558. The spring 558 pushes against the first protrusion 550 forcing the first member 514 up or in a second direction 40 to a second position 513 causing the structure of blocks 26 built on the top surface 518 to topple off of the first member 514 or "explode."

Batteries may be required for an electrical signal and may be position within any of the members, voids, actuators, platforms or the like. Any battery type is contemplated as the need for extensive power is not necessary since the only actuation is the requirement of release of the clip 560.

Mechanically, the button 536 may be pushed which mechanically pulls or pushes the clip 560 away from the flange 556 causing substantially the same reaction as described previously. A more substantial channel 528 may be required for a mechanical actuation versus an electronic actuation.

Figure 10:
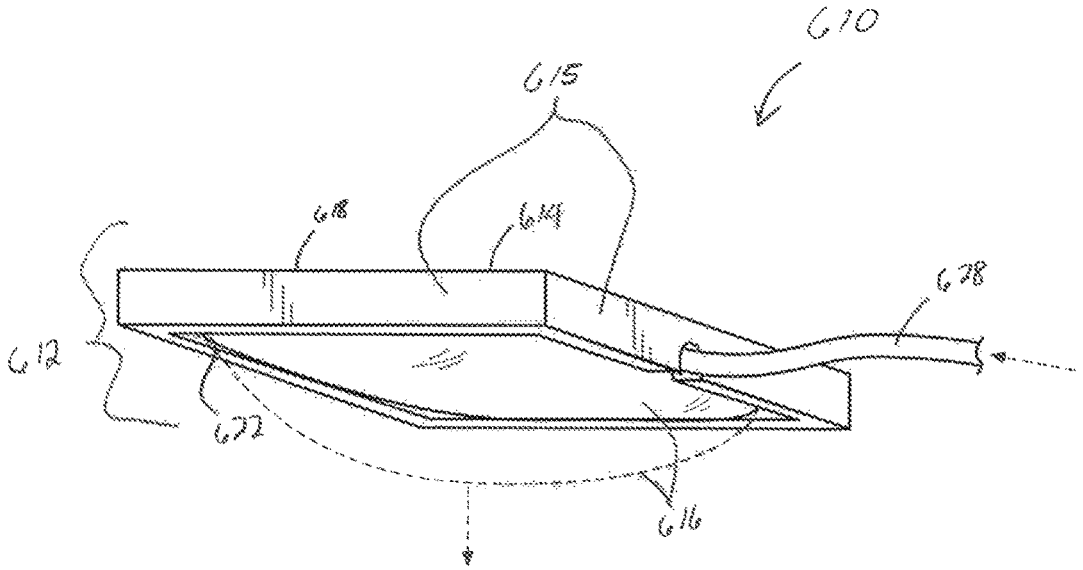
FIG. 10 is one embodiment of a bottom perspective view of platform of FIG. 1.

Referring to FIG. 10, an alternate embodiment of a system 610 with a platform 612 is depicted. The platform 612, from a top perspective view, may be square or other polygonal shape. The platform 612 may include a first member 614 with a top surface 618, or wall, that may allow for blocks or other materials to be built thereon. The first member 614 may also include circumferential walls 615 extending downward from the top surface 618. The walls 615 and the top surface 618 may create an open bottomed box with a void 622 between the walls 615 and top surface 618. The walls 615 and top surface 622 may allow for a second member 616 to sit within the void 622. One of the walls 615 may include a cutout 617, or hole, that allows a channel 628, or tube, to pass through the wall 615 of the first member 614 allowing the platform 612 to remain stable.

The second member 616 may be a bladder or air chamber that when deflated may reside entirely within the void 622. Actuation of the second member 616 may be substantially similar to previous embodiments described herein in that when an actuator is pushed air flows through the channel 628 into the second member 616 causing the second member 616 to expand beyond the void 622, destabilizing the platform 612 and thus toppling or "exploding" the structure built on the top surface 618.

The second member 616 and the channel 628 may be a single unitary piece or they may be a separate bladder and tube that are cohesively connected.

Figure 11:
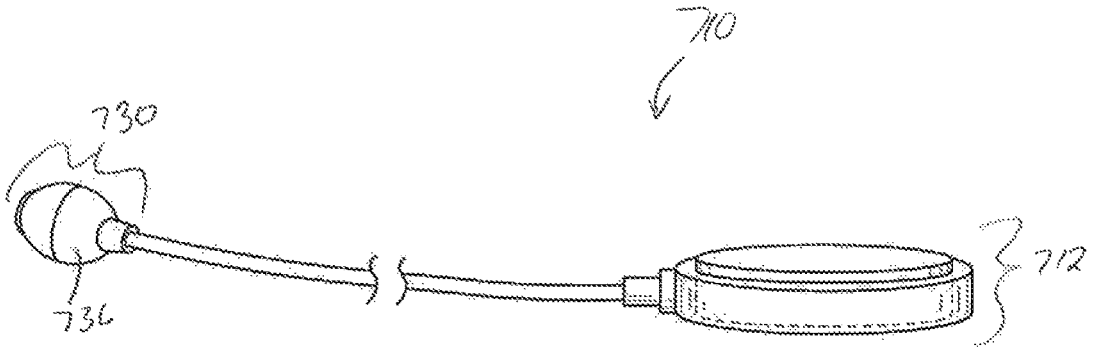
FIG. 11 is a perspective view of an alternate embodiment of the game or system of FIG. 1 with an alternate actuator.

Referring to FIG. 11, an alternate embodiment of an actuator 730 of a system 710 is depicted. A platform 712 may be substantially similar as previously described embodiments found herein. The actuator 730 may include a bulbous air-chamber 736 which may resemble a pump. The actuator 730 may be ovoid or spherical and allow for easy compression. While the figure depicts these two shapes any shape is contemplated that allows for easy actuation of the air-chamber 736. The actuator 730 may be comprised of a rubber or other pliable material that allows for easy compression and decompression.

Figure 12:
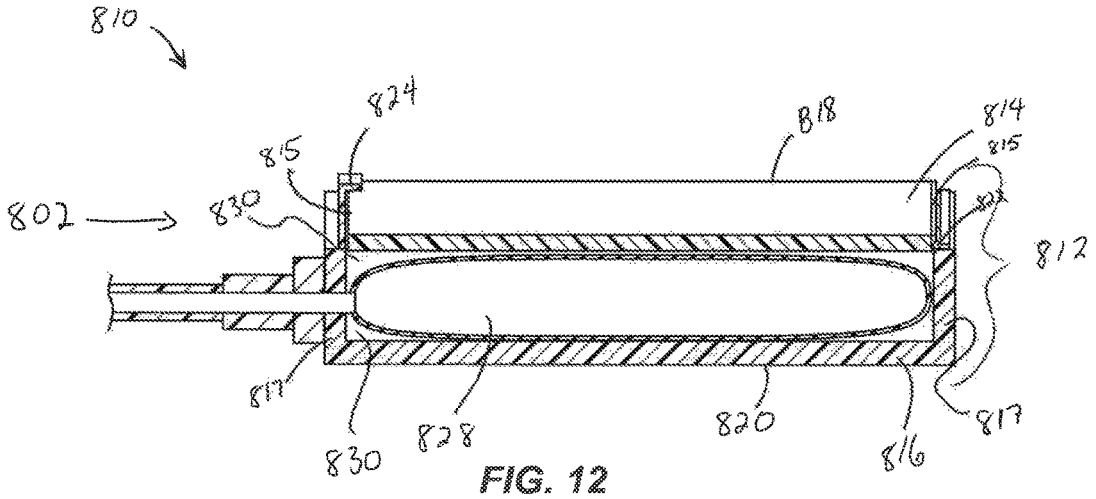

Referring to FIG. 12, an alternate embodiment of a system 810 is depicted with a platform 812 which may include a first member 814 and a second member 816. The platform 812 may be square shaped from a top view, but may take any polygonal shape. The first member 814 may include a top surface 818 that faces upwards and side walls 815 which may extend downward from the top surface 818. The second member 816 may provide a base that the walls 815 of the top surface 818 rest on. The second member 816 may include a substantially flat bottom surface 820 that allows the platform 812 to rest substantially flat on a surface such as a table or floor. The second member 816 may include walls 817 that extend upward from the bottom surface 820. The walls 815 of the first member 814 may sit flush with the walls 817 of the second member 816 when the platform 812 is in a first position 802.

A hinge 822 may be positioned on one side of the walls 815, 817 and engage both walls 815, 817 on the one side. The hinge 822 may provide stability and replaceability so that the walls 815, 817 sit flush against one another. The hinge may allow for the first member 814 to flip or be moved away from the second member 816, in a third direction 42, along the other side walls 815, 817 that are not engaged by the hinge, thus allowing a swinging door action of the first member 814 from the second member 816.

The second member 816 may also include a stop 824 protruding upward from the wall 817 opposite the hinged wall that prevents the first member 814 from extending too far away from the second member 816. The stop 824 may catch a lip 826 of the first member 814 preventing the first member 814 from swinging entirely "open."

Figure 13:
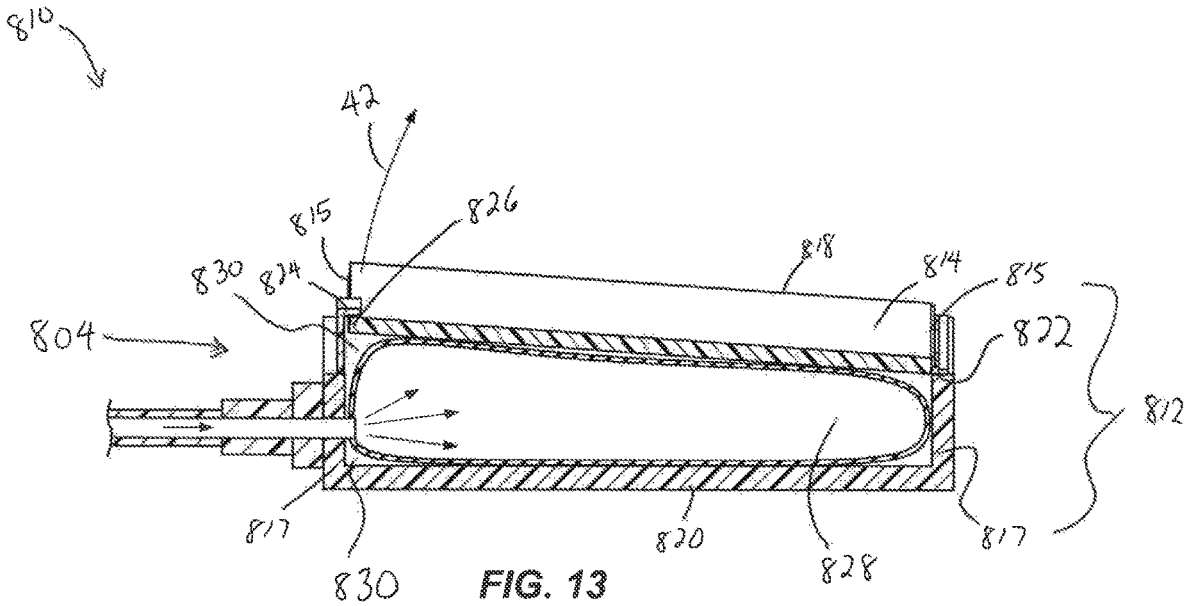

A bladder 828, or air chamber, may reside within a void 830 that is spaced between the first member 814 and second member 816 and the walls 815, 817 of those first and second members 814, 816. Referring to FIG. 13, the bladder 828 may be expandable within the void 830 in any number of ways including those previously disclosed herein. When the bladder 828 expands it may force the first member 814 to move away from the second member 816 to a second position 804. The expansion of the bladder 828 causing the movement of the first member 814 destabilizes the first member 814 causing the structure being built on the top surface 818 to topple, fall over or "explode."

The hinge 822 forces one side wall 815 to remain in place while the remainder of the side walls 815 is lifted from off of the side walls 817 of the second member. The hinge 822 allows for easy replacement of the first member 814 from the first position 802 back to the second position 804. The stop 824 also provides ease in replacement of the first member 814 back to the first position 802 so that the entire first member does not have to be flipped back over. However, it will be appreciated that a stop 824 is not necessary to function and the platform 812 may function just as easily without it.

The bladder or air chambers within the system may be comprised of simple rubbers or plastics or of a nylon, microfleece, vinyl or polyester face fabric with a thermoplastic polyurethane (TPU) or thermoplastic elastomer (TPE) laminate. Other materials may also be used such as a mesh fabric with TPU or even the TPE and TPU by themselves. Essentially any material that can be sealed or laminated with an air tight membrane, such as woven and nonwoven goods maybe used herein and other possible fabrics, materials, plastics may also be considered and are contemplated.

Each of the different embodiments may allow for easy replacement of an actuator, channel, first member or second member of a platform, or the platform itself. The game may be modular and different actuators paired with different platforms depending on the user's preference.

The game may further include cards with predefined structures that are to be built on the system. The cards may be held in a card holder. A single card holder that holds a card in a vertical position may be utilized and may be positioned between two users, or players. The game is set up with a first player setting up a system wherein one actuator and a separate, unconnected, platform is positioned toward the first player and a second system is set up wherein a second actuator and a second separate, unconnected, platform is positioned toward a second player wherein the first players actuator controls the second players platform and the second actuator controls the first players platform.

One of the players takes a card with the predefined structure and places it within the single card holder or flat on a surface so both players may easily see the structure. Both players commence building on the platforms in front of them. The player who builds the predefined structure as outlined on the card first may then activate the actuator in front of him or her thus destabilizing the other player's, or opponent's, platform and thus or "exploding" or toppling the structure.

Although the foregoing disclosure provides many specifics, these should not be construed as limiting the scope any of the ensuing claims. Other embodiments may be devised which do not depart from the scopes of the claims. Features from different embodiments may be employed separately or in combination. Accordingly, all additions, deletions and modifications to the disclosed subject matter that fall within the scopes of the claims are to be embraced thereby. The scope of each claim is indicated and limited only by its plain language and the full scope of available legal equivalents to its elements.

What is claimed:

1. A game system comprising: a platform connected to a tube, the platform comprising: a first planar member, polygonal in shape, the first planar member with a circumferential lip; and a second member, with a same polygonal shape as the first member, in connection with the first member the second member comprising a stop configured to catch the circumferential lip, wherein the first member and second member are movable with respect to each other, wherein the at least a portion of the first planar member may reversibly reside within the second member; a void between the first planar member and the second member, wherein the second member circumferentially surrounds the void and the first planar member resides at least partially within the void; a first configuration wherein the platform is in a first position; and a second configuration wherein the platform is in an unstable second position; an actuator connected to the tube and spaced apart from the platform; an air-chamber within the actuator that when actuated forces air from the actuator to the platform, wherein the air causes the first member and second member to move with respect to each other.

2. The system of claim 1, wherein the first planar member comprises a flat top surface to allow building of a structure on the platform.

3. The system of claim 2, wherein the first planar member slidably engages within the second member.

4. The system of claim 3, wherein the void is airtight.

5. The system of claim 1, wherein the actuator is a deformable accordion-like structure.

6. The system of claim 2, wherein the second member comprises a deformable bladder that when air is forced from the actuator thru the tube to the deformable bladder it causes the bladder to inflate and destabilize the platform.

7. The system of claim 2, wherein the first member comprises at least one extendable post that when air is forced from the actuator thru the tube to the platform it causes the at least one extendable post to extend, destabilizing the platform.

8. The system of claim 1 further comprising, a stackable material capable of forming a structure; wherein the stackable material is building blocks.

9. The platform of claim 1 further comprising:

a hinge connecting the first member to the second member, wherein the hinge is positioned along at least one side wall of each of the first member and the second member.

10. A system comprising:

a podium connected to a conduit, the podium comprising:

a first member comprising a planar top surface and a first protrusion extending opposite the top surface, and a lip extending transverse from a side wall, the first protrusion comprising:

a flange toward a distal end of the first protrusion, the flange extending circumferentially and laterally from the first protrusion; and a second member in connection with the first member, the second member comprising a stop configured to catch the lip; wherein the first member is movable with respect to the second member;

a first configuration wherein the podium is in a first position;

a second configuration wherein the podium is in an unstable second position; and a void between the first planar member and the second member, the second member circumferentially surrounds the void, and the first planar member resides at least partially within the void;

an actuator connected to the conduit and spaced apart from the podium;

a button connected to the actuator capable of sending an electrical signal through the conduit, wherein the electrical signal causes the first member to move with respect to the second member.

11. The system of claim 10, wherein the top surface comprises a flat top surface to allow building of a structure on the podium.

12. The system of claim 11, wherein the first member slidably engages within the second member forming a void between the first member and second member.

13. The system of claim 12, wherein the second member comprises:

a boss extending from a base of the second member;

a spring positioned on the boss; and a clip.

14. The system of claim 13, wherein the clip engages the flange when the first member is pressed into the second member, reversible securing the podium in the first position.

15. The system of claim 14, wherein the clip is spring loaded and is electrically connected to the button via the conduit, wherein when the button is pressed the clip releases the flange forcing the podium into the second position by the spring moving from a first compressed position to a second decompressed position, wherein the spring pushes the first member upward.

16. The system of claim 10 further comprising, a stackable material capable of forming a structure; wherein the stackable material is building blocks.

* * * * *